United States Patent [19]

Abraham

[11] Patent Number: 4,887,716

[45] Date of Patent: Dec. 19, 1989

[54] FLOATING BEVERAGE CARRIER WITH COLLAPSIBLE PORTIONS

[76] Inventor: Tim Abraham, 700 E. Union Ct., Broken Arrow, Okla. 74011

[21] Appl. No.: 362,560

[22] Filed: Jun. 7, 1989

[51] Int. Cl.[4] ..... B65D 75/00

[52] U.S. Cl. ..... 206/427; 206/139; 220/1 R; 220/21; 441/1

[58] Field of Search ..... 206/139, 199, 203, 427, 206/523; 220/1 R, 21, 85 H; 294/151, 159, 172; 441/1

[56] References Cited

U.S. PATENT DOCUMENTS

| | | | |
|---|---|---|---|
| 2,404,594 | 7/1946 | Pfleumer | 441/1 |
| 3,015,406 | 1/1962 | Nolte | 220/1 |
| 3,367,525 | 2/1968 | Elder | 220/1 |
| 3,533,529 | 10/1970 | Helbig | 220/1 |
| 3,656,749 | 4/1972 | Reyes | 441/1 |
| 3,831,209 | 8/1974 | Clingman | 9/1 A |
| 4,119,248 | 10/1978 | Butler et al. | 206/203 |
| 4,295,345 | 10/1981 | Atkinson | 206/427 |
| 4,571,194 | 2/1986 | Kiss et al. | 441/1 |
| 4,802,602 | 2/1989 | Evans et al. | 220/85 H |

*Primary Examiner*—David T. Fidei
*Attorney, Agent, or Firm*—Henderson & Sturm

[57] ABSTRACT

A floating beverage carrier apparatus (10) for cans (102) and bottles (101) wherein the apparatus includes an apertured flotation member (13) provided with a plurality of collapsible receptacles (16) for supporting the beverage containers (100) in the apparatus (10) during use; and, wherein the receptacles (16) are adapted to be collapsed within the apertures (15) during storage of the apparatus.

4 Claims, 1 Drawing Sheet

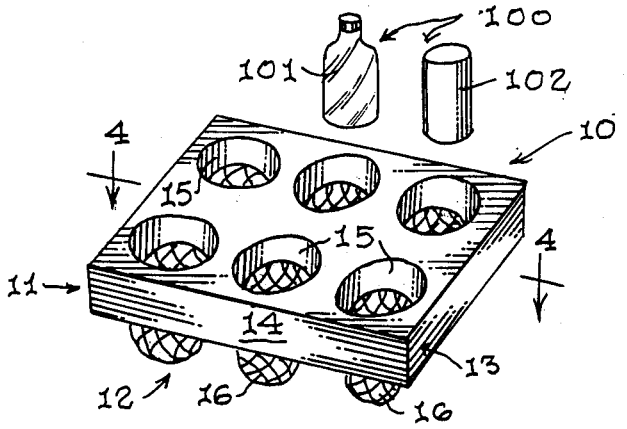
FIG. 1.
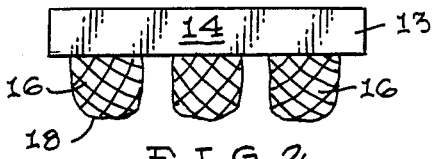
FIG. 2.
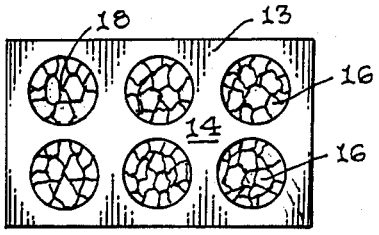
FIG. 3.
FIG. 4.
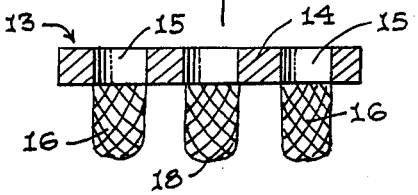
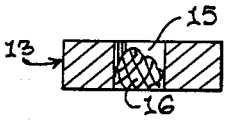
FIG. 5.

FLOATING BEVERAGE CARRIER WITH COLLAPSIBLE PORTIONS

TECHNICAL FIELD

The present invention relates to beverage carriers in general, and more particularly to a bouyant beverage carrier.

BACKGROUND OF THE INVENTION

As can be seen by reference to the following U.S. Pat. No's: 3,831,209; 3,015,406; 3,367,525; 4,571,194; and, 3,533,529 the prior art is replete with myriad and diverse floating or bouyant beverage carrier constructions.

While all of the aforementioned prior art constructions are more than adequate for the basic purpose and function for which they are specifically designed, these devices also share some common deficiencies in a number of respects.

To begin with virtually all of the known floating beverage carriers employ a generally rigid overall construction which involves costly manufacturing processes. In addition, this rigid construction further prohibits the nesting or stacked storage of a plurality of the beverage carriers both in warehouse facilities and commercial outlets which means that only a limited number of the carriers can be conveniently put on display for retail sales.

As a consequence of the foregoing situation there has existed a longstanding need among manufacturers, retailers and consumers for a fully functional floating beverage carrier that is collapsible so that it occupies the smallest possible space while in storage or on display in a store; and, the provision of such a structural arrangement is a stated objective of the present invention.

SUMMARY OF THE INVENTION

Briefly stated, the present invention involves a floating beverage carrier comprising a flotation unit and a collapsible beverage container retention unit.

The flotation unit comprises an apertured flotation member wherein the apertures are dimensioned to accommodate the insertion of beverage containers in either can or bottle form.

In addition, the collapsible beverage container retention unit comprises a plurality of flexible netting receptacles wherein each of the apertures in the flotation member are operatively associated with one of the flexible receptacles such that a beverage container can be supported within the receptacles which are suspended beneath the flotation member.

BRIEF DESCRIPTION OF THE DRAWINGS

These and other objects, advantages and novel features of the invention will become apparent from the detailed description of the best mode for carrying out the preferred embodiment of the invention which follows; particularly when considered in conjunction with the accompanying drawings, wherein:

FIG. 1 is a perspective view of the apparatus;

FIG. 2 is a side plan view of the apparatus;

FIG. 3 is a top plan view of the apparatus;

FIG. 4 is a cross-sectional view taken through line 4—4 of FIG. 1; and, FIG. 5 is an enlarged cross-sectional detail view of the collapsed disposition of the flexible netting of the apparatus.

BEST MODE FOR CARRYING OUT THE INVENTION

As can be seen by reference to the drawings, and in particular to FIG. 1, the floating beverage carrier apparatus that forms the basis of the present invention is designated generally by the reference numeral (10). The apparatus (10) comprises in general: a flotation unit (11) and a collapsible beverage container retention unit (12). These units will now be described in seriatim fashion.

As shown in FIGS. 1 thru 5, the flotation unit (11) comprises a generally rectangular flotation member (13) fabricated from a suitable lightweight bouyant material (14) such as cork, foam, etc. In addition, the flotation member (13) is further provided with a plurality of apertures (15) which are dimensioned to receive beverage containers (100) such as bottles (101) or cans (102).

As can also be seen by reference to FIGS. 1 thru 5, the beverage container retention unit (12) comprises a plurality of collapsible receptacle members (16) fabricated from flexible netting (18), or the like; wherein, each of the collapsible receptacle members (16) are suspended from the bottom of the flotation member (13), an operatively associated with one of the plurality of beverage container receiving apertures (15) in the flotation member (13).

As can best be appreciated by reference to FIG. 4, when the apparatus (10) is deployed in its operative mode of disposition, beverage containers inserted in the apertures (15) will be supported by the receptacle members (16) and the interstices in the netting will allow liquid to circulate around the periphery of the individual containers (100).

Turning now to FIG. 5, it can be appreciated that when the apparatus (10) is deployed in its stored mode of disposition the collapsible receptacle members (16) will fold up inside the apertures (15) of the flotation member (13) such that the space occupied by the apparatus (10) in storage or on display will be no greater than the volume occupied by the flotation member (13) alone.

Having thereby described the subject matter of this invention it should be apparent that many substitutions, modifications and variations of the invention are possible in light of the above teachings. It is therefore to be understood that the invention as taught and described herein is only to be limited to the extent of the breadth and scope of the appended claims.

I claim:

1. A floating beverage carrier apparatus for beverage containers including bottles and cans wherein the apparatus comprises:

a flotation unit including a flotation member provided with a plurality of apertures dimensioned to receive beverage containers; and, a plurality of collapsible beverage container receptacles wherein each beverage container receptacle is operatively associated with one of the plurality of apertures in said flotation member.

2. The apparatus as in claim 1 wherein said flotation member is fabricated from a lightweight bouyant material.

3. The apparatus as in claim 1 wherein said collapsible receptacles are fabricated from flexible netting.

4. The apparatus as in claim 1 wherein said collapsible receptacles are suspended from the bottom of said flotation member.

* * * * *